US005764204A

United States Patent [19]

Bancal

[11] Patent Number: 5,764,204

[45] Date of Patent: Jun. 9, 1998

[54] TWO-GATE FLAT DISPLAY SCREEN

[75] Inventor: Bernard Bancal, Luynes, France

[73] Assignee: Pixtech S.A., Rousset, France

[21] Appl. No.: 618,171

[22] Filed: Mar. 19, 1996

[30] Foreign Application Priority Data

Mar. 22, 1995 [FR] France ..... 95 03570

[51] Int. Cl.[6] ..... G09G 3/22

[52] U.S. Cl. ..... 345/74; 345/75; 313/333; 315/169.1

[58] Field of Search ..... 345/74, 75, 76, 345/77, 147, 149, 152; 315/169.1, 169.3; 313/336, 351, 495, 496, 497

[56] References Cited

U.S. PATENT DOCUMENTS

| | | | |
|---|---|---|---|
| 3,935,500 | 1/1976 | Oess et al. . | |
| 4,908,539 | 3/1990 | Meyer | 315/169.1 |
| 5,012,153 | 4/1991 | Atkinson et al. | 315/169.1 |
| 5,191,217 | 3/1993 | Kane et al. | 315/169.1 |
| 5,461,396 | 10/1995 | Nakatani et al. | 345/75 |
| 5,557,296 | 9/1996 | Lambert et al. | 345/74 |
| 5,625,253 | 4/1997 | Van Gorkom et al. | 345/75 |

FOREIGN PATENT DOCUMENTS

| | | |
|---|---|---|
| 0660368 | 6/1995 | European Pat. Off. . |
| 2708380 | 2/1995 | France . |
| 2712426 | 3/1995 | France . |

*Primary Examiner*—Xiao Wu
*Attorney, Agent, or Firm*—Plevy & Associates

[57] ABSTRACT

A flat display screen includes a cathode arranged in columns for electronically bombarding an anode including phosphor elements, a first gate arranged in rows to be individually addressed, and a second gate formed by at least two combs of alternate paths parallel with the rows of the first gate. A same row of the first gate is associated with a path of each comb and the interconnection of each path with a cathode column defines a screen pixel.

8 Claims, 2 Drawing Sheets

TWO-GATE FLAT DISPLAY SCREEN

BACKGROUND OF THE INVENTION

1. Field of the Invention

The present invention relates to the fabrication of a flat display screen, and more particularly to a flat display screen comprising a cathode for electronically bombarding an anode including phosphor elements. It can be, for example, a fluorescent screen in which the electron emission is obtained by extraction from microtips or a thin layer, for example a carbondiamond film.

2. Discussion of the Related Art

FIG. 1 represents the structure of a flat microtip screen with microtips of the type used according to the invention.

Such microtip screens are mainly constituted by a cathode 1 including microtips 2 and by a gate 3 provided with holes 4 corresponding to the positions of the microtips 2. Cathode 1 is disposed so as to face a cathodoluminescent anode 5, formed on a glass substrate 6 that constitutes the screen surface.

The operation and the detailed structure of such a microtip screen are described in U.S. Pat. No. 4,940,916 assigned to Commissariat a l'Energie Atomique.

The cathode 1 is disposed in columns and is constituted, onto a glass substrate 10, of cathode conductors arranged in meshes from a conductive layer. The microtips 2 are disposed onto a resistive layer 11 that is deposited onto the cathode conductors and are disposed inside meshes defined by the cathode conductors. FIG. 1 partially represents the inside of a mesh, without the cathode conductors. The cathode 1 is associated with the gate 3 which is arranged in rows, an insulating layer (not shown) being interposed between the cathode conductors and the gate 3. The intersection of a row of gate 3 with a column of cathode 1 defines a pixel.

This device uses the electric field generated between the cathode 1 and gate 3 so that electrons are transferred from microtips 2 toward phosphor elements 7 of anode 5 crossing an inter-electrode vacuum gap 12.

In color screens, the anode 5 comprises alternate phosphor strips 7, each strip corresponding to a color (red, green, blue). The strips are separated one from the other by an insulating material 8. The phosphor elements 7 are deposited onto electrodes 9, which are constituted by corresponding strips of a transparent conductive layer such as indium and tin oxide (ITO). The groups of red, green, blue strips are alternatively biased with respect to cathode 1 so that the electrons extracted from the microtips 2 of one pixel of the cathode/gate are alternatively directed toward the facing phosphor elements 7 of each color.

Pictures are displayed by suitably biasing the anode, the cathode and the gate through an electronic control system (not shown).

Generally, the rows of gate 3 are sequentially biased at a potential of approximately 80 volts whereas the phosphor strips (for example **7*g* in FIG. 1) that must be excited are biased at a voltage of approximately 400 volts, the other strips (for example 7*r* and 7*b* in FIG. 1) are at zero. The columns of cathode 1, whose potential determines for each row of gate 3** the brightness of the pixel defined by the intersection of the cathode column and the gate row in the considered color, are brought to respective voltages ranging between a maximum emission potential and a zero-emission potential (for example, 0 and 30 volts respectively).

The values of the biasing potentials are determined by the characteristics of the phosphor elements 7 and microtips 2.

Conventionally, below a potential difference of 50 volts between the cathode and the gate, no electron emission occurs, and the maximum emission used corresponds to a voltage difference of 80 volts.

A drawback of conventional screens is that the individual addressing of the rows of gate 3 requires a connection to the electronic control system for each row. Thus, the electronic control system must include an output stage for each gate row, which increases its cost. Furthermore, the output stages associated with the gate must be adapted to withstand voltages which can reach 100 volts, which makes them relatively expensive. In addition, since the silicon surface area is proportional to the square of the breakover voltage, such output stages, which are incorporated in integrated circuits, require a relatively important surface.

A further drawback is that the need for an external connection for each gate row makes it impossible to fabricate high definition and small-size screens because of the minimum gaps to be maintained between two connections of two adjacent rows, because it is very difficult to realize connections with gaps smaller than 200 μm.

SUMMARY OF THE INVENTION

An object of the present invention is to avoid the above drawbacks by providing a flat display screen in which the number of output stages and connections for addressing the gate is smaller than the number of rows of the screen.

Another object of the invention aims is to realize a high definition and small-size screen.

Another object of the invention aims is to realize such a flat display screen that does not require modifications of the anode and cathode, nor of the elements of the electronic control system associated with the cathode or anode.

To achieve these objects, the present invention provides a flat display screen including a cathode arranged in columns for electronically bombarding an anode including phosphor elements, and including a first gate arranged in rows to be individually addressed, and a second gate formed by at least two combs of alternate paths parallel with the rows of the first gate, a same row of the first gate being associated with a path of each comb and the interconnection of each path with a cathode column defining a screen pixel.

According to an embodiment of the invention, pictures are displayed in an interlaced manner by sequentially addressing the rows of the first gate during an alternate addressing of the combs of the second gate.

According to an embodiment of the invention, the cathode columns are simultaneously addressed at each addressing of a row of the first gate, their voltage depending on the desired brightness of the pixel defined by their intersection with a path of the addressed comb of the second gate which faces the current row.

According to an embodiment of the invention, the biasing voltages of the combs are selected so that the paths of an addressed comb focus, toward the anode, the electrons emitted by the cathode columns facing the focusing comb's path that is associated with an addressed row, and so that the paths of a comb which is not addressed collect the electrons emitted by the cathode columns facing the path of the collecting comb associated with the addressed row.

According to an embodiment of the invention, the voltage of a focusing comb is higher than the voltage of the rows of the first gate which are not addressed, the voltage of a collecting comb being lower than the voltage of the rows of the first gate which are not addressed.

According to an embodiment of the invention, the pitch of the rows of the first gate is sized as a function of the minimum pitch to be complied with between the individual connections of these rows toward an electronic control system, the number of combs of the second gate being selected as a function of the desired definition of the screen.

According to an embodiment of the invention, the gates are used in a color screen whose anode has three groups of alternate phosphor strips, each corresponding to one color.

According to an embodiment of the invention, the gates are used in a monocolor screen whose anode is formed by phosphor elements of a single type.

The foregoing and other objects, features, aspects and advantages of the invention will become apparent from the following detailed description of the present invention when taken in conjunction with the accompanying drawings.

BRIEF DESCRIPTION OF THE DRAWINGS

For the sake of clarity, the figures are not drawn to scale and the same elements are referenced with the same reference characters in the various figures.

DETAILED DESCRIPTION

The basic idea of the present invention is to associate with the cathode of a screen two differently addressed, superposed and parallel gates.

Figure 2:
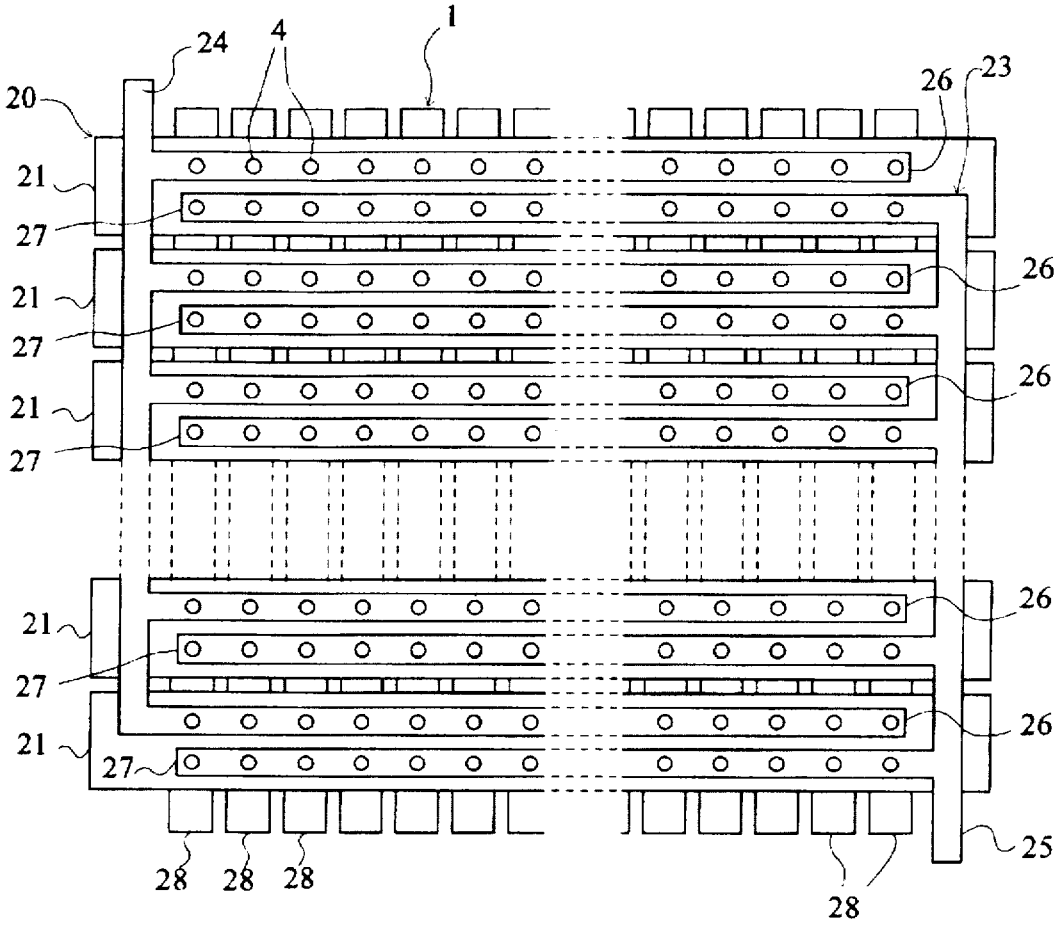
FIG. 2 is a top view of a cathode/gate plate of a flat display screen according to an embodiment of the present invention.

FIG. 2 is a top view illustrating an embodiment of the invention with a cathode/gate plate of a microtip screen.

Figure 1:
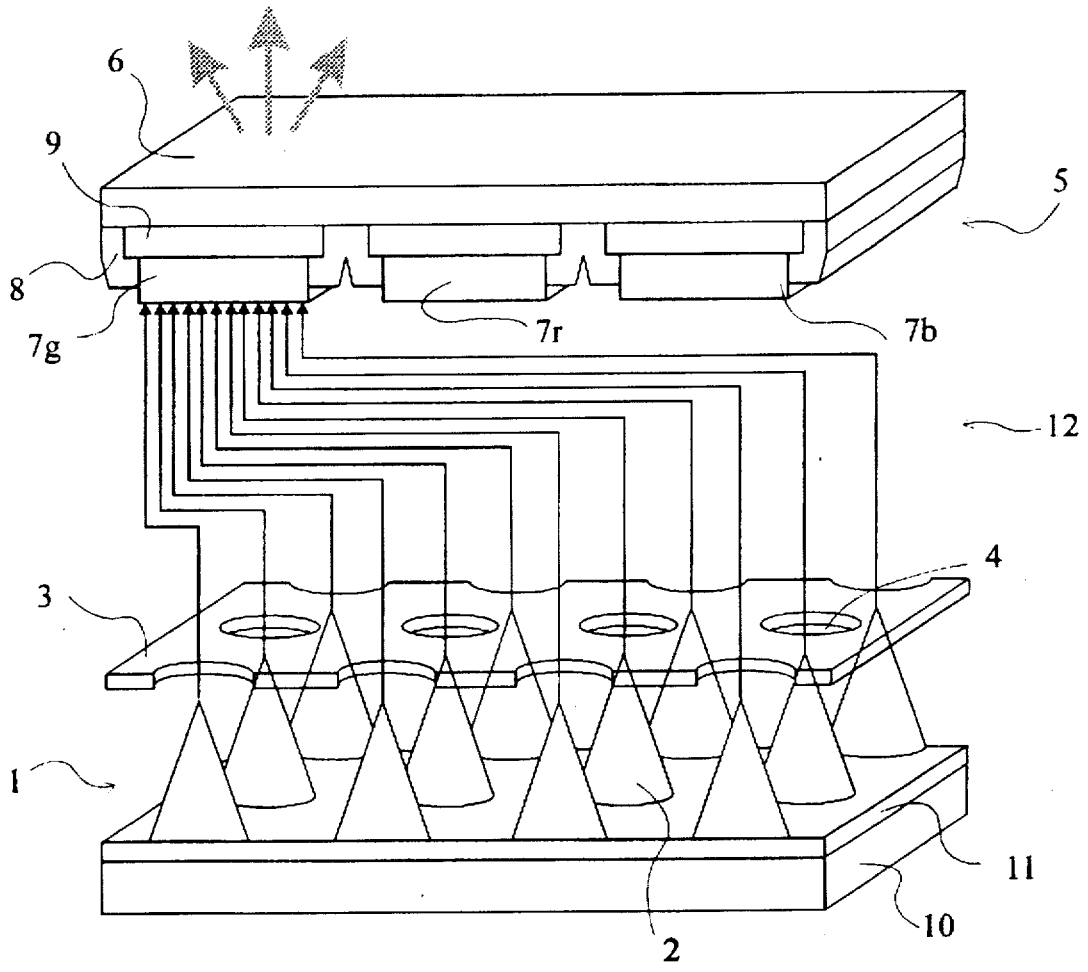
FIG. 1, above described, illustrates the state of the art and the problem encountered.

A first gate 20 is similar to the gate (3, FIG. 1) included in a conventional screen except that the width of its rows 21 corresponds at least to two pixels of the screen. The rows 21 of the first gate 20 are individually addressed and are thus individually connected by one of their ends to an electronic control system (not shown).

A second gate 23 is disposed over the first gate 20. The second gate 23 is formed by at least two combs 24 and 25 of alternated conductive paths, 26 and 27, respectively. A path of each comb faces a row 21 of the first gate 20 so that each row 21 is covered by two paths 26 and 27 of the second gate 23. Because of their arrangement as a comb, all the paths 26, respectively 27, can be simultaneously addressed while being interconnected to the electronic control system. In this case, a screen pixel is defined by the intersection of a column, or a conductor 28, of cathode 1 with a path 26 or 27 of the second gate 23.

The rows 21 of the first gate 20 and the paths 26 and 27 of the second gate 23 have holes 4 facing the microtips disposed on conductors 28 of cathode 1 which are arranged in columns. For the sake of clarity, one hole per pixel is represented in FIG. 2 whereas, in practice, the number of holes 4 correspond to the number of microtips and they are several thousand holes per screen pixel. Similarly, the meshing of the cathode conductors 28 is not represented.

Gates 20 and 23 are fabricated in the same manner as the gate of a conventional screen. Each gate is, for example, formed by a nobium layer etched according to a suitable pattern. Insulating layers, etched out in front of each microtip, are interposed between cathode 1 and the first gate 20 and between the first gate 20 and the second gate 23.

The role of each comb 24 or 25 of the second gate 23 is to allow, alternatively, whether or not it is addressed, the focusing of electrons emitted by the microtips facing the row 21 addressed by the first gate 20 and the addressed path 26, respectively 27, or the collection of electrons emitted by the microtips facing the addressed row 21 and the non-addressed path 27, respectively 26.

Pictures are displayed during a frame time (for example 20 ms) by suitably biasing the anode, the cathode and the gates by the electronic control system. For a color screen, the phosphor strips 7 of anode 5 are sequentially biased during a frame duration, by groups of strips of a same color, or during a sub-frame duration corresponding to one third of the frame duration (for example 6.6 ms).

According to the invention, display is achieved line after line in an interlaced manner, during each sub-frame duration. In other words, one of the combs (for example 24) of the second gate 23 is first addressed and all the rows 21 of the first gate 20 are sequentially addressed during a "line time" during which each column 28 of cathode 1 is brought to a voltage depending upon the brightness of the pixel to be displayed along the path (for example 26) associated with the current row 21 in the considered color.

The biasing of columns 28 of cathode 1 changes at each new row 21 of the line scanning of the first gate 20. A "line time" (for example 13.7 ps) corresponds to the duration of a subframe divided by the number of rows 21 of the first gate 20 multiplied by the number of combs of the second gate 23.

While a comb (for example 24) is being addressed, the electrons, emitted by the microtips facing the path (for example 27) of the other comb (for example 25) and of the current row 21 of the first gate 20, are collected by this path (for example 27).

Figure 3:
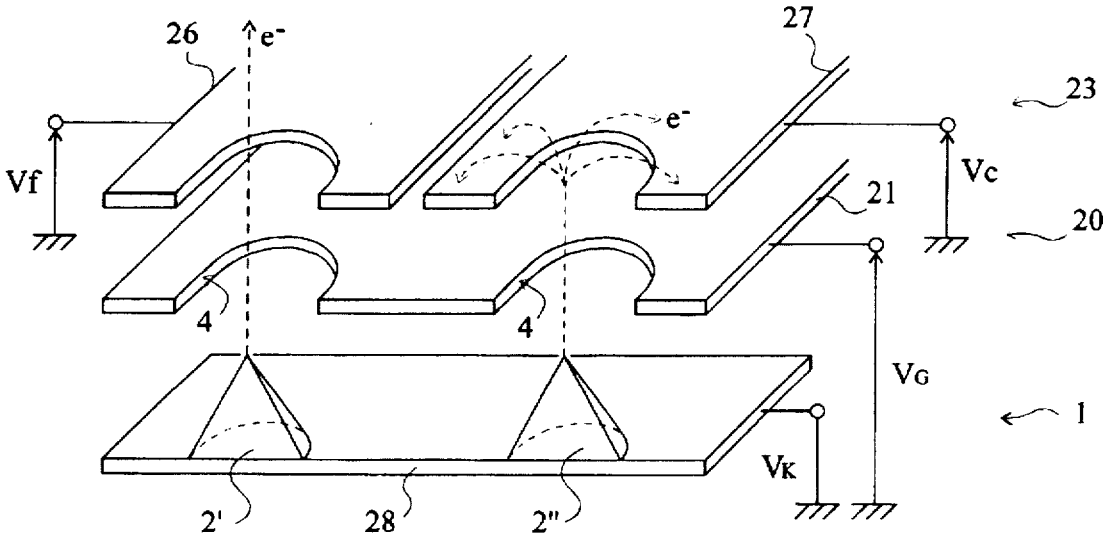
FIG. 3 is an partial exploded perspective view of the cathode/gate of FIG. 2.

This operation is illustrated in FIG. 3 which is an 30 exploded partial perspective view of a conductor 28 of cathode 1 and of two.gates 20 and 23 according to the invention. As in the case of FIG. 2, only one microtip 2 and one hole 4 per pixel are represented.

It is assumed in FIG. 3 that the comb 24 and the repre35 sented row 21 of the first gate 20 are addressed. Thus, the electrons emitted by the microtip 2', facing the path 26 of comb 24, are focused toward the anode (not shown) whereas the electrons emitted by the microtip 2", facing path 27 of comb 25, are collected by the path 27.

Voltage VG of a row 21 of the first gate 20 which is addressed is, as in conventional screens, for example 80 volts whereas it is 0 volt for the rows 21 which are not addressed. Voltage VK of columns 28 of the cathode ranges, as for conventional screens, for example from 0 to 30 volts as a function of the desired brightness for the considered pixel.

To enable focusing of the electrons, voltage Vf of the paths of an addressed comb is higher than the voltage of the rows 21 which are not addressed. If the first gate 20 is biased between 0 and 80 volts, a voltage Vf of approximately 5 volts, for example, will be selected for the focusing comb.

To enable collection of the electrons by the paths of the other comb, its voltage Vc is lower than the voltage of the rows 21 which are not addressed. If the first gate 20 is biased between 0 and 80 volt a voltage Vc of approximately −5 volts, for example, will be selected for the collecting comb.

The number of combs of the second gate 23 is selected as a function of the number of output stages, or connection pads, that are desired for the gates and/or upon the desired definition of the screen toward columns 28 of cathode 1 and/or the form in which the luminance commands arrive in the electronic control system.

A two-combs implementation, as represented in FIGS. 2 and 3, is particularly adapted to televisions signals in which the lines are generally interlaced.

The second gate 23 can also comprise three combs, i.e., a comb for each color.

Also the second gate 23 can include a higher number of combs. For example, it can be desired to store the digitized pictures in a frame memory whose content can be easily read by Jumps of 8 rows. Then, eight combs can be advantageously provided for the second gate 23, thus enabling to display eight successive interlaced sub-frames.

An advantage of the invention is that, for a screen including a determined number N of lines, the number of output stages of the electronic control system associated with the gates, therefore of connections of the gates to the electronic control system, is M+N/M, where M is the number of combs of the second gate 23. In the example represented in FIGS. 2 and 3, the number of output stages and connections necessary for the gates is practically halved.

In an exemplary embodiment, a screen according to the invention including 288 lines and 360 columns, its second gate including two combs, can be achieved by using 146 (144 for rows 21 and 2 for combs 24 and 25) output stages and connections that are associated with the gates.

Another advantage of the present invention is that it reduces the number of output stages and connections without modifying neither the structure of the cathode and the screen anode, nor the electronic control system associated with the cathode and the anode.

A further advantage of the present invention is it enables to achieve high definition and small-size screens, in which the length of at least one side of a pixel is lower than the minimum gap between the connections of the gate rows. Indeed, for a screen wherein the pitch of rows 21 of the first gate 20 which corresponds to the minimum possible pitch (for example 200 pm), the implementation of the present invention increases the screen's definition, at least along the direction perpendicular to the gate rows, by a factor M corresponding to the number of combs of the second gate 23. In the example represented in FIGS. 2 and 3, this amounts to double the screen definition perpendicular to the row direction.

To increase the screen's definition in both directions the density of the connections of the columns of the cathode and/or of the first gate must be increased. For this purpose, for example, the connections of the cathode columns can be disposed alternatively at either end of these columns, which doubles the screen's definition along the direction of the gate rows.

In an exemplary embodiment, a square of 1024 pixels per side, according to the invention, has been achieved on a 10-cm×10-cm square surface. The pitch of the pixels was approximately 0.1 mm. The pitch of rows 21 of the first gate 20 was 0.2 mm, which is compatible with the minimum gap for conventional connections. Each path 26 or 27 of the second gate 23 had a width of approximately 75 μm, and two adjacent paths were separated by approximately 25 μm.

As is apparent to those skilled in the art, various modifications can be made to the present invention. In particular, each of the described elements of a layer can be replaced with one or more elements having the same function. Similarly, the sizes and voltages given by way of example can be modified as a function of the definition and features of the screen.

In addition, although color screens have been cited by way of example, the invention also applies to a monocolor screen whether or not its anode is formed by a continuous plane of phosphor elements.

Furthermore, the present invention also applies to fluorescent screens whose cathode is formed by an electron emitting film, for example made of carbon-diamond.

I claim:

1. A flat display screen including a cathode (1) arranged in columns (28) for electronically bombarding an anode (5) including phosphor elements (7), including a first gate (20) arranged in rows (21) to be individually addressed, and a second gate (23) formed by at least two combs (24,25) of alternate paths (26,27) parallel with the rows of said first gate, a same row (21) of said first gate (20) being associated with a path of each comb and the intersection of each path with a cathode column (28) defining a screen pixel.

2. The flat display screen of claim 1, wherein the pitch of the rows of the first gate (20) is sized as a function of the minimum pitch to be complied with between the individual connections of these rows to an electronic control system, the number of combs (24, 25) of the second gate (23) being selected as a function of the desired definition of the screen.

3. The flat display screen of claim 1, applied to a color screen whose anode (5) has three groups of alternate phosphor strips (7), each corresponding to one color.

4. The flat display screen of claim 1, applied to a monocolor screen whose anode (5) is formed by phosphor elements (7) of a single type.

5. A flat display screen including a cathode (1) arranged in columns (28) for electronically bombarding an anode (5) including phosphor elements (7), including a first gate (20) arranged in rows (21) to be individually addressed, and a second gate (23) formed by at least two combs (24,25) of alternate paths (26,27) parallel with the rows of said first gate, a same row (21) of said first gate (20) being associated with a path of eacb comb and the intersection of each path with a cathode column (28) defining a screen pixel, wherein pictures are displayed in an interlaced manner by sequentially addressing the rows (21) of the first gate (20) during an alternate addressing of said combs (24,25) of the second gate (23).

6. The flat display screen of claim 5, wherein the cathode columns are simultaneously addressed at each addressing of a row (21) of the first gate (20), their voltage depending on the desired brightness of the pixel defined by their intersection with a path (26, 27) of the addressed comb (24, 25) of the second gate (23) which faces the current row.

7. The flat display screen of claim 5 wherein the biasing voltages of said combs (24, 25) are selected so that the paths (26, 27) of an addressed comb focus toward the anode (5) the electrons emitted by the cathode columns facing the focusing comb's path that is associated with an addressed row, and so that the paths of a non-addressed comb collect the electrons emitted by the cathode columns facing the path of said collecting comb associated w h the addressed row.

8. The flat display screen of claim 7 wherein the voltage of a focusing comb (24, 25) is higher than the voltage of the non-addressed rows (21) of the first gate, the voltage of a collecting comb (25, 24) being lower than the voltage of the nonaddressed rows (21) of the first gate (20).

* * * * *